US005497995A

United States Patent [19]

Swisshelm

[11] Patent Number: 5,497,995

[45] Date of Patent: Mar. 12, 1996

[54] METALWOOD WITH RAISED SOLE

[76] Inventor: Charles T. Swisshelm, 1422 Bullard La., Tustin, Calif. 92680

[21] Appl. No.: 283,047

[22] Filed: Jul. 29, 1994

[51] Int. Cl.[6] ..... A63B 53/04

[52] U.S. Cl. ..... 273/172; 273/167 A; 273/167 H; 273/167 F

[58] Field of Search ..... 273/167 R, 168, 273/78, 169, 170, 171, 172, 173, 174, 175, 167 A, 167 B, 167 C, 167 D, 167 E, 167 F, 167 G, 167 H, 167 J, 167 K, 77 A, 187.4, 186.2, 193 R, 194 A; D21/214, 219

[56] References Cited

U.S. PATENT DOCUMENTS

| | | | |
|---|---|---|---|
| D. 192,515 | 4/1962 | Henrich . | |
| D. 298,269 | 10/1988 | Flood . | |
| D. 326,886 | 6/1992 | Sun et al. . | |
| 1,555,425 | 9/1925 | McKenzie | 273/167 E |
| 1,669,482 | 5/1928 | Miller | 273/174 |
| 3,976,299 | 8/1976 | Lawrence | 273/167 F |
| 4,214,754 | 7/1980 | Zebelean . | |
| 4,332,388 | 6/1982 | Crow | 273/167 A |
| 4,432,549 | 2/1984 | Zebelean . | |
| 4,754,977 | 7/1988 | Sahm . | |
| 4,896,885 | 1/1990 | Kajita | 273/167 H |
| 4,944,515 | 7/1990 | Shearer | 273/173 |
| 5,058,895 | 10/1991 | Igarasahi . | |
| 5,141,230 | 8/1992 | Antonious . | |
| 5,213,329 | 5/1993 | Okumoto et al. . | |
| 5,257,786 | 11/1993 | Gorman . | |
| 5,288,079 | 2/1994 | Katayama | 273/167 A |

FOREIGN PATENT DOCUMENTS 22113 of 1909 United Kingdom .

OTHER PUBLICATIONS

"Golf Digest" Magazine, Jun. 1977 Issue.

*Primary Examiner*—Sebastiano Passaniti
*Attorney, Agent, or Firm*—Raymond Sun

[57] ABSTRACT

A metalwood golf club head comprises a ball-striking face having a top edge, a bottom edge, and a center of percussion located at an approximate center of the face. The club head further comprises a top surface extending from the top edge of the face to a top edge of a narrow rear surface. The club head further comprises a sole plate having a narrow leading edge extending substantially horizontally from the bottom edge of the face, and a base extending substantially horizontally from a bottom edge of the narrow rear surface, with the base having substantially the same vertical level as the center of percussion. The club head further comprises a plurality of rails extending downwardly from the base of the sole plate, each rail comprising a bottom surface and two side walls connected by the bottom surface, wherein each bottom surface extends substantially horizontally from the narrow leading edge of the sole plate to support the club head when the club head is rested on the ground.

17 Claims, 8 Drawing Sheets

METALWOOD WITH RAISED SOLE

BACKGROUND OF THE INVENTION

1. Field of the Invention

The present invention relates to golf clubs, and in particular, to a metalwood golf club having a sole plate that is raised to a vertical level at about the center of percussion of the club face to promote increased accuracy and distance on shots.

2. Description of the Related Art

Traditional golf wood club heads were made of wood, such as laminated maple or a solid block of persimmon, which is cut and sanded into the desired shape. Since the club head was made of solid wood, it was difficult to distribute weight around the club head. Weight distribution around the club head became important because it was realized that proper weight distribution at certain locations of the club head could greatly assist a golfer to hit the ball more accurately, and in some instances, hit the ball further. Some manufacturers were able to drill a hole in the center bottom portion of the club head and add some weight at that point, but there was little else that one could do to distribute weight on a wooden club head.

In the early 1970's, a process was designed for investment cast steel to be shaped in the configuration of a wood club head having a hollow center. Such club heads made from investment cast steel were known as "metalwoods". One important advantage of this process was that weight or mass could be evenly distributed around the outer edges or surfaces of the club head, including the top surface, the rear surface, the sole, the toe and the heel. This essentially expanded the size of the center of percussion or "sweet spot" of the club face, thereby allowing the club head to perform better (i.e., be more "forgiving") to shots that were hit off-center. The weight distribution for most of the earlier metalwoods is concentrated primarily in the club face and the sole. This tends to launch the ball at a higher trajectory because of additional weight being below the ball upon impact.

The next major change in metalwood design was to provide "oversized" metalwoods. The weight distribution did not change, except that the weight was being distributed over a larger area to increase the center of percussion and to provide a larger club face or hitting area for better performance by the average golfer.

Notwithstanding the above developments, numerous attempts were still made to distribute the weight or mass around the club head of a metalwood. For example, U.S. Pat. Nos. 4,754,977 to Sahm, 5,058,895 to Igarashi and 5,141,230 to Antonious, U.S. Pat. Nos. Des. 192,515 to Henrich, 298,269 to Flood, and 326,886 to Sun et al. and GB 22,113 to Park illustrate club heads having discrete weights either formed or provided on the outer surfaces of the club head. Further examples are shown in U.S. Pat. Nos. 4,214,754 and 4,432,549, both to Zebelean, which illustrate driver club heads in which the thickness or mass of the walls of the club heads is varied to reduce the torque and/or deflection of the club heads. The club heads in U.S. Pat. No. 5,213,329 to Okumoto et al. and U.S. Pat. Nos. 5,257,786 and 5,314,185, both to Gorman, have struts or projections provided in the sole plate.

Notwithstanding the above-described efforts and improvements, there still remains a need for a metalwood design which assists the average golfer in hitting the ball further and more accurately.

SUMMARY OF THE INVENTION

The objects of the present invention may be achieved by providing a metalwood golf club head comprising a ball-striking face having a top edge, a bottom edge, and a center of percussion located at an approximate center of the face. The club head further comprises a top surface extending from the top edge of the face to a top edge of a narrow rear surface. The club head further comprises a sole plate having a narrow leading edge extending substantially horizontally from the bottom edge of the face, and a base extending from a bottom edge of the narrow rear surface, with the base having substantially the same vertical level as the center of percussion. The club head further comprises a plurality of rails extending downwardly from the base of the sole plate, each rail comprising a bottom surface and two side walls connected by the bottom surface, wherein each bottom surface extends substantially horizontally from the narrow leading edge of the sole plate to support the club head when the club head is rested on the ground.

The club head according to the present invention further includes a sloped surface extending at an angle, or a vertical wall, to connect the base and the narrow leading edge. The base is positioned slightly above or below the vertical level of the center of percussion. The base may also be slanted at an angle from the bottom edge of the narrow rear surface to the sloped surface.

In the club head according to the present invention, the side walls of each rail may be substantially vertical, or may be provided at an angle. Each rail further comprises a rear portion which is curved upwardly from the bottom surface to connect the base of the sole plate. The size, shape, weight and position of each rail may be varied.

For example, in one embodiment according to the present invention, the club head comprises two rails, with a first rail positioned behind the face at an extremity of the center of percussion closer to the heel portion, and a second rail positioned behind the face at an extremity of the center of percussion closer to the toe portion.

In another embodiment according to the present invention, the club head comprises three rails spaced-apart across the sole plate. In yet another embodiment according to the present invention, the club head comprises two rails, one provided at the heel portion and another provided at the toe portion. In a further embodiment according to the present invention, the club head comprises one rail provided behind the approximate location of the center of percussion. Therefore, the metalwood of the present invention promotes greater accuracy and increased distance on golf shots by concentrating more weight or mass directly behind the center of percussion. This is accomplished by raising the sole plate of the club head to approximately the same vertical height or level of the center of percussion, which for most metalwood club heads, is at the approximate center of the ball-striking face. This is further accomplished by providing a plurality of rails spaced-apart on the sole plate of the club head.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
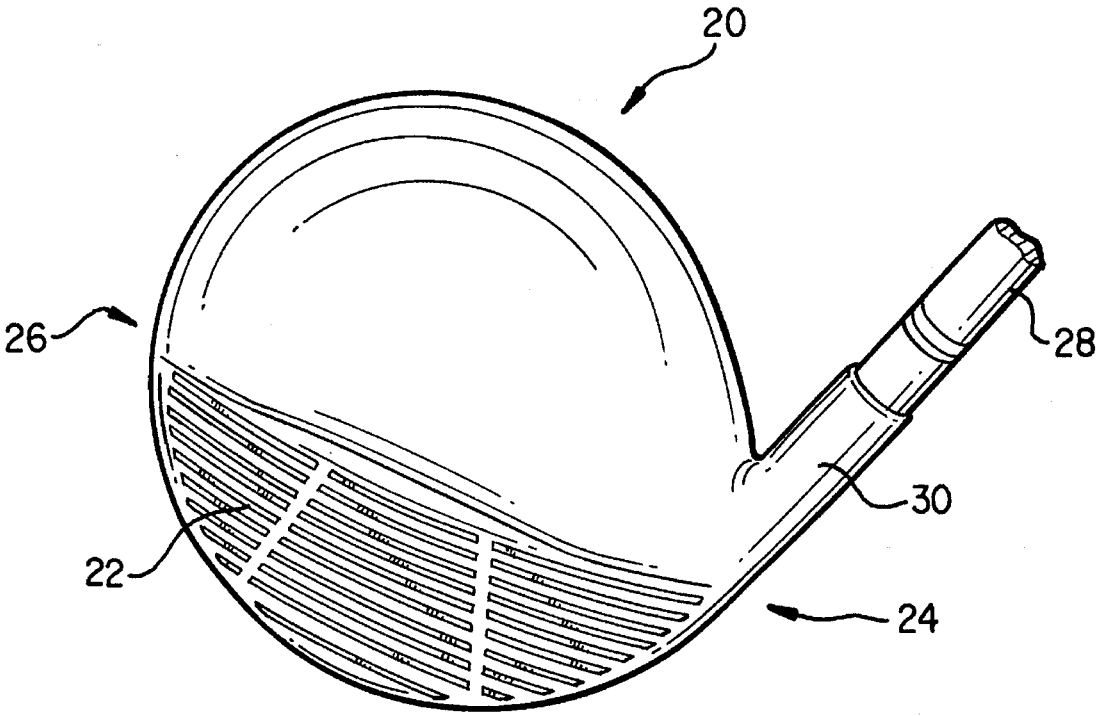
FIG. 1 is a perspective view of a first embodiment of the metalwood of the present invention.
Figure 2:
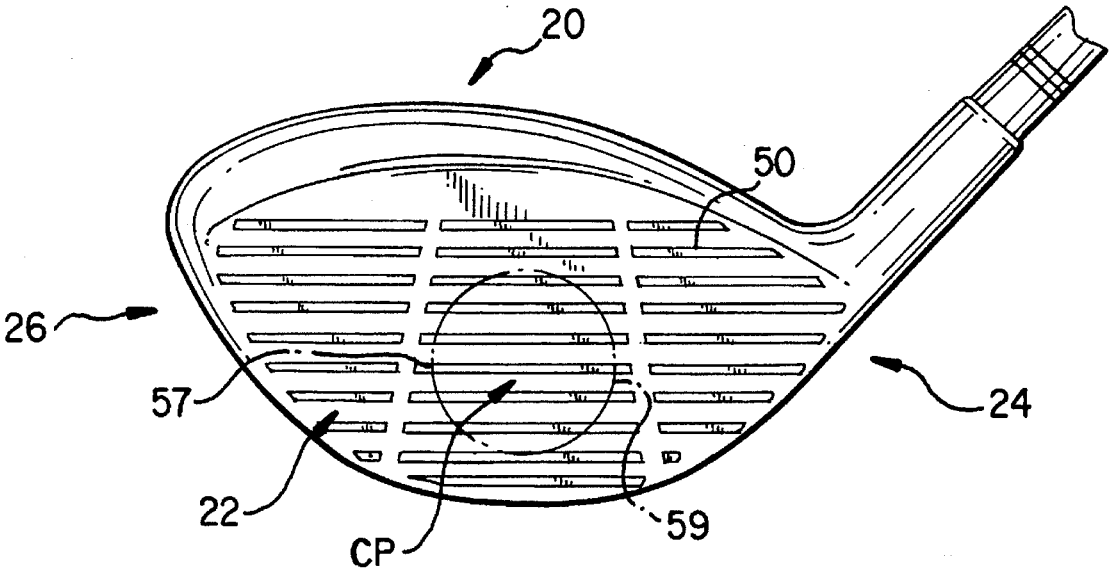
FIG. 2 is a front view or club face view of the metalwood of FIG. 1.
Figure 3:
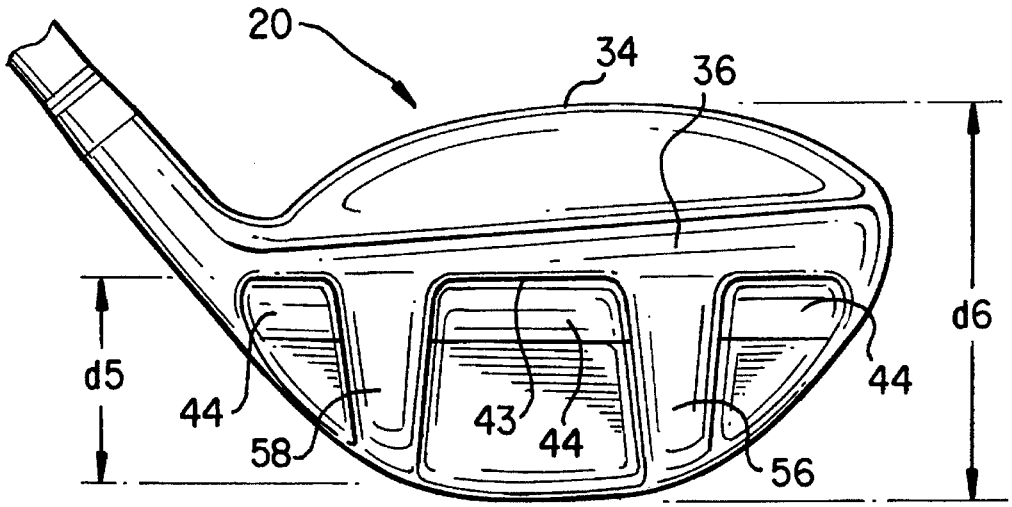
FIG. 3 is a rear view of the metalwood of FIG. 1.

FIGS. 1 and 2 illustrates a first preferred embodiment of the present invention. A golf club head or metalwood 20 has a ball-striking face 22, a heel portion 24, and a toe portion 26. The face 22 has a center of percussion or "sweet spot" CP, which represents the spot of desired contact with the ball. This center of percussion CP is preferably located at approximately the center of the face 22 and has a diameter of approximately 1.685 inches, which is the diameter of a golf ball designed to meet the specifications of the United States Golf Association. However, depending on the size of the club head 20, the center of percussion CP could have a slightly larger size, and could extend a small distance in any direction from the exact center of the face 22.

A shaft 28 is connected to the club head 20 through a hosel 30 disposed adjacent to the heel portion 24 and having an opening therein which receives the shaft 28. The shaft 28 may be of any particular configuration so long as it provides for the proper swing, and may be made from stainless steel or reinforced composites, such as boron, graphite, titanium or aluminum.

Referring particularly to FIGS. 2–8, the club head 20 is formed with a hollow cavity 32. The hollow cavity 32 is formed by investment casting of a metal, such as steel, aluminum alloy or titanium, or a composite material, such as graphite, kevlar or graphite, which specifically creates a rounded or curved top 34, as well as the face 22, a narrow rear surface 36, and a sole plate 38. The top surface 34, rear surface 36 and sole plate 38 that define the hollow cavity 32 are all weighted to concentrate weight or mass along the surfaces of the club head 20. The rounded top surface 34 leads rearwardly from a top edge 39 of the face 22 to a top edge 40 of a narrow rear surface 36. This narrow rear surface 36 is then curved or angled downwardly in a direction toward the face 22 to a bottom edge 42 which is at approximately the same vertical height of the center of percussion CP of face 22.

The sole plate 38 extends substantially horizontally from the bottom edge 42 of the narrow rear surface 26 along a base 43 to a sloped surface 44 in which the sole plate 38 slopes downwardly at an angle in the direction of the face 22 toward a narrow leading edge 46 which is at the same vertical level as the bottom edge 48 of the face 22, which is at ground level. The base 43 encompasses within its meaning and scope bases 43 that comprise of a straight or flat surface extending either completely horizontally or at an angle, either upwardly or downwardly, from the bottom edge 42 to the sloped surface 44. Alternatively, the base 43 may also include a base that has a slightly curved surface extending from the bottom edge 42 to the sloped surface 44.

Figure 4:
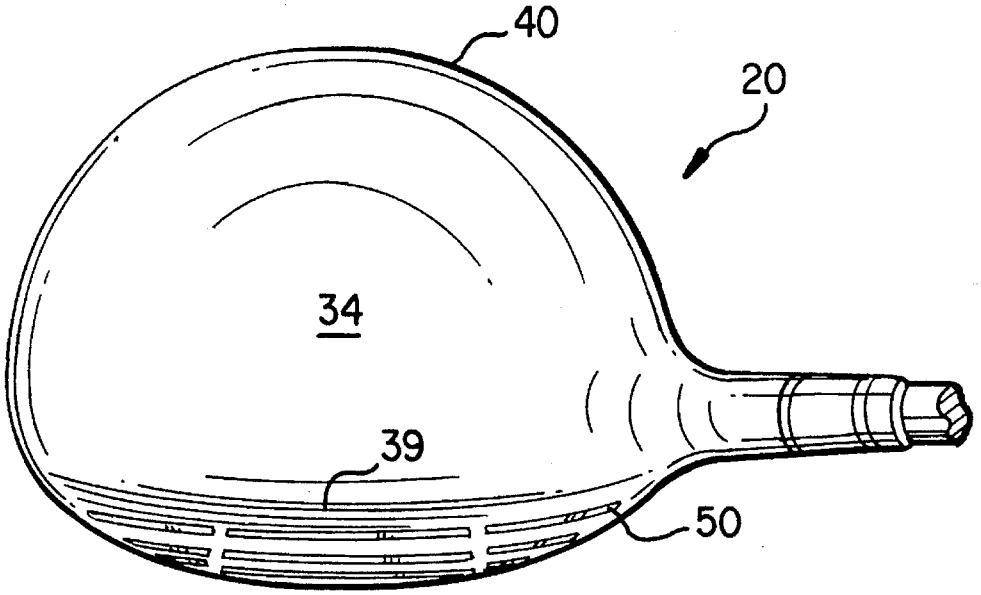
FIG. 4 is a top plan view of the metalwood of FIG. 1.
Figure 6:
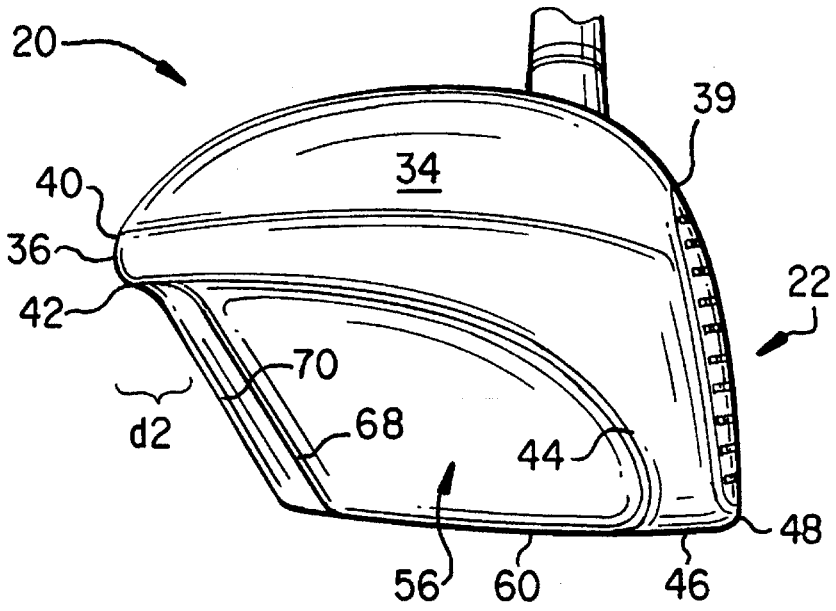
FIG. 6 is a toe view of the metalwood of FIG. 1.
Figure 7:
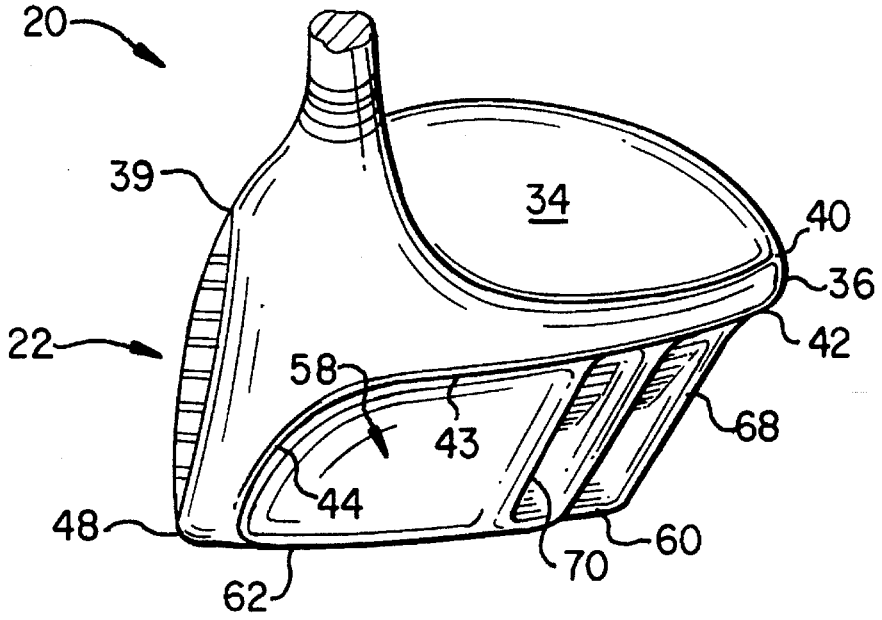
FIG. 7 is a heel view of the metalwood of FIG. 1.
Figure 8:
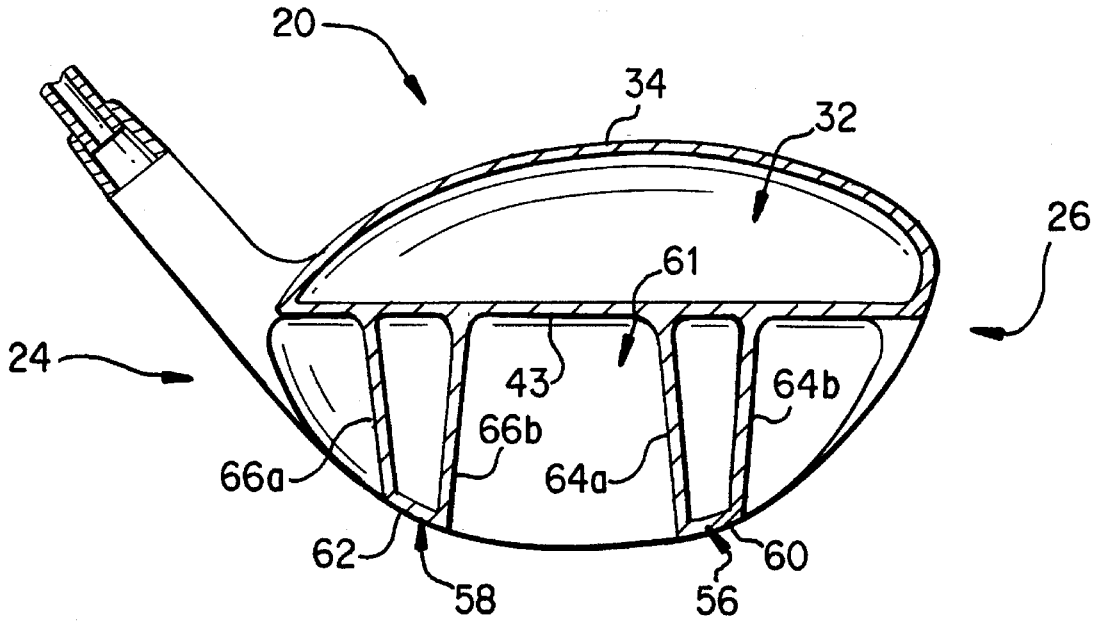
FIG. 8 is a cross-sectional view of the metalwood of FIG. 5 taken along lines 8—8.

The face 22 is a conventional metalwood club head face, which is a substantially flat surface but having a slight outward bulge, as shown in FIGS. 4, 6 and 7. The surface of the face 22 is positioned at an angle (see FIGS. 6 and 7) to provide the desired club head loft. For example, the face 22 of a driver is typically provided with a 8 to 12 degree loft, while that of a three-wood is typically provided with a 15 degree loft. The surface of the face 22 has scorelines 50 provided horizontally across for increasing friction between the ball and the face 22, which increases the spin on the ball to enable the ball to perform better aerodynamically.

Thus, the club head 20 according to the present invention has a raised sole plate 38 in that most of the plate or surface of the sole 38 is not at ground level, but is raised to a higher vertical level. "Ground level" is intended to mean that level which contacts the ground when the club head 20 is rested flat on the ground. Only the narrow leading edge 46 extending substantially horizontally from the bottom edge 48 of the face 22, and the bottom surfaces 60, 62 of the rails 56, 58, as described hereinbelow, are at ground level. The sole plate 38 then slopes angularly upwardly from the leading edge 46 along the sloped surface 44 to the substantially horizontal base 43. The substantially horizontal base 43 is at approximately the same vertical level as the center of percussion CP to provide additional mass or weight behind the center of percussion, which is the critical point of contact.

The sole plate of a traditional metalwood is the bottom surface of the club head that rests on the ground when a golfer addresses the ball with the club face ("the address position"). Such traditional metalwoods provide a weighted sole which concentrates the weight or mass below the ball on contact, thereby helping to launch the ball upwardly upon contact. In the present invention, most of the weighted sole plate 38 is raised to approximately the same vertical level as the center of percussion CP to concentrate the weight directly behind the center of percussion CP, thereby helping to drive the ball further and straighter. By increasing the mass directly behind the center of percussion CP, the energy transferred to the ball upon impact is increased, thereby increasing the distance. The weight or mass of the base 43 at the toe and heel portions 24, 26 act to counterbalance each other, thereby increasing the width of the center of percussion CP as well as increasing the accuracy of the shot by improving the "gear effect" on balls struck near the heel or toe portions 24, 26. This "gear effect" is caused by the slight bulge of the face 22 which tends to spin the ball towards the center of the target line.

In addition, the metalwood according to the present invention comprises two rails 56 and 58 extending downwardly from the horizontal base 43 of the sole plate 38. The rails 56 and 58 may be provided integrally with the club head 20 and its sole plate 38 by investment casting the rails 56 and 58 together with the sole plate 38. When provided integrally, the interiors of the rails 56 and 58 may be hollow (see FIG. 8). Alternatively, the rails 56 and 58 may be provided separately and attached to the sole plate 38 by brazing, welding or epoxying.

Figure 5:
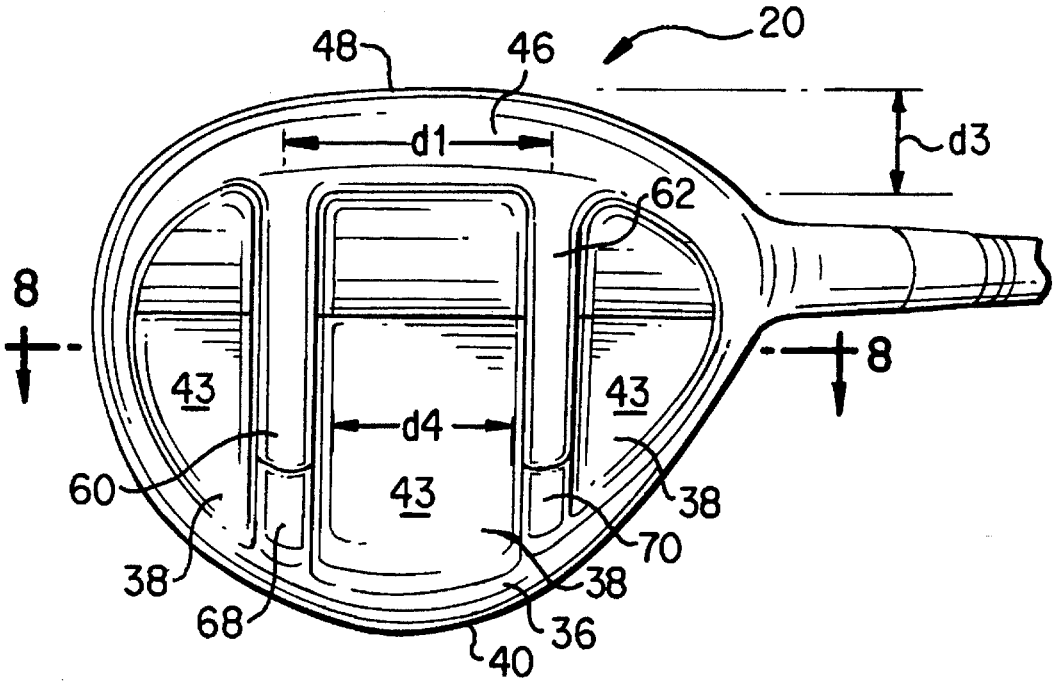
FIG. 5 is a bottom plan view or sole view of the metalwood of FIG. 1.

Each rail 56 and 58 comprises a bottom surface 60 and 62, respectively, both of which are at ground level and extend rearwardly from the narrow leading edge 46. Each rail 56 and 58 is defined by a pair of vertical side walls 64*a*, 64*b* and 66*a*, 66*b*, respectively, each pair of side walls 64*a*, 64*b* and 66*a*, 66*b* being connected by the bottom surface 60 or 62, respectively. The two rails 56 and 58 are preferably positioned at a distance d1 of about 1.685 inches apart from each other, when measured from the center of one rail to the other. Referring specifically to FIGS. 5–7, the bottom surfaces 60 and 62 are substantially straight for a significant portion of their length, but begin to slope upwardly at an angle at a rear portion 68 and 70, respectively, until they meet the horizontal base 43 of the sole plate 38, a short distance d2 from the bottom edge 42. The distance d2 preferably ranges from about 0.15 to 0.55 inches, and the rails 56 and 58 are caused to terminate prior to the bottom edge 42 to allow for the sole plate 38 to be welded or otherwise connected to the club head 20, if desired, as explained in greater detail hereinbelow.

One rail 56 is preferably positioned behind the extreme point 57 of the center of percussion CP closest to the toe portion 26, while the other rail 58 is preferably positioned behind the extreme point 59 of the center of percussion CP closest to the heel portion 24. Alternatively, each rail 56 or 58 may be positioned at any point between an extreme point 57 or 59 of the center of percussion CP and the outermost point of either the heel portion 24 or the toe portion 26. Thus, these rails 56 and 58 are positioned behind the approximate center of the face 22 and define a central trough 61 directly behind the center of the face 22. The side walls 64*a*, 64*b* and 66*a*, 66*b* and bottom surfaces 60 and 62 may be selectively weighted to provide the desired mass behind the center of percussion CP.

The rails 56 and 58 serve several functions. First, the rails 56 and 58, with the bottom surfaces 60 and 62 flush with the narrow leading edge 46, allow the club head 20 to rest properly on the ground at the address position without the need for the golfer to manipulate the shaft or the grip of the club. Second, the two rails 56 and 58 are positioned behind approximately the outer extremities of the center of percussion CP to add weight directly behind the golf ball upon impact. Even when the ball is struck "off-center" on the heel or toe portion of the face 22, the weight of the rails 56 and 58 will help to increase the overall distance. Third, the rails 56 and 58 act together on shots struck directly at the center of percussion CP as balanced directional weight masses to ensure that the ball travels straight down the desired target line.

The club head 20 may be provided or casted as one integral part or as two parts. If provided as two separate parts, a first part would preferably comprise the face 22, the heel portion 24 adjacent the hosel 30, the toe portion 26, the rounded top surface 34, and the narrow rear surface 36 to the bottom edge 42. A second part would essentially comprise the sole plate 38, which includes the base 43 from bottom edge 42, the sloped surface 44, the rails 56 and 58, and the narrow leading edge 46. Thus, the first part would comprise an opening (not shown) defining the hollow interior of the club head 20, with the sole plate 38 covering the opening to create the hollow interior. Both parts would be provided as integral parts, and then attached by welding, epoxy or adhesives.

Some non-limiting dimensions will now be provided, although it will be appreciated by those skilled in the art that these dimensions represent mere examples, and that these dimensions may be modified without departing from the spirit and scope of the present invention. For instance, the narrow leading edge 46 extends from the bottom edge 48 of the face 22 to the sloped surface 44 by a distance d3 ranging from 0.175 to 0.65 inches, and preferably, 0.465 inches. The width of each rail 56 and 58 ranges from 0.2 to 0.6 inches, and is preferably 0.4 inches. Further, the distance d4 between the vertical walls 64*a* and 66*b* of the rails 56 and 58 ranges from 0.9 to 1.5 inches, and is preferably 1.29 inches. The distance d5, which represents the height to which the base 43 of the sole plate 38 is raised from the ground level, preferably ranges from 0.75 to 0.95 inches. Finally, the distance d6 from the bottom edge 48 of the face 22 to the highest vertical point of the curved top surface 34 preferably ranges from about 1.6 to 1.85 inches.

It will be appreciated by those skilled in the art that modifications to the structure of the club head 20 shown and described above may be provided without departing from the spirit and scope of the present invention. By way of example only, and in no way intending to limit the alternatives that can be encompassed by the appended claims, the base 43 of the sole 38 does not need to be raised to the same vertical level of the center of percussion CP. Instead, the base 43 can be raised to a vertical level ranging from slightly below the center of percussion CP to slightly above the center of percussion CP. For example, to aid a golfer in getting better loft on a golf ball, the horizontal base 43 can be raised to a vertical level slightly below the center of percussion CP. Alternatively, a better player may desire to have the base 43 raised to a vertical level slightly above the center of percussion CP to have a lower launch angle so that the ball would have a lower trajectory. Thus, the level of the base 43 can be customized to fit a specific golfer's needs.

Further, the sloped surface 44 does not need to be sloped or angled; it could comprise a vertical wall rising vertically from the narrow leading edge 46 to the base 43.

Additionally, although both rails 56 and 58 are described and shown as having the same width and weight, it is possible to provide the rails 56 and 58 with different widths and weights. For example, the rail 56 closer the toe portion 26 may be wider and/or provided with more weight to help a golfer who normally slices or pushes his shots to the right to minimize the slice. Likewise, the rail 58 closer the heel portion 24 may be wider and/or provided with more weight to help a golfer who normally hooks or pulls the ball to the left to minimize the hook.

Figure 9:
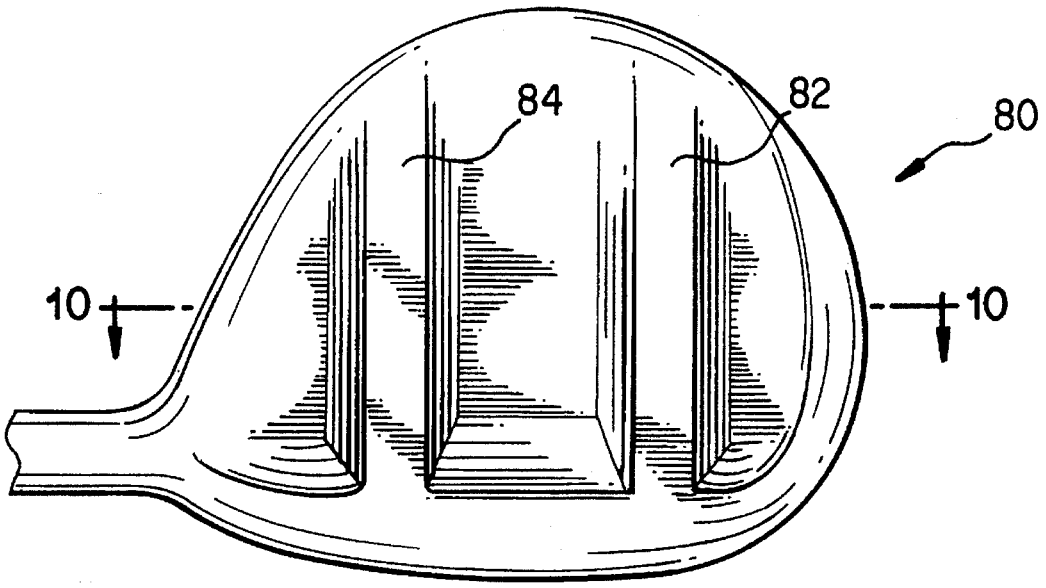
FIG. 9 is a bottom plan view or sole view of a second embodiment of the metalwood according to the present invention.
Figure 10:
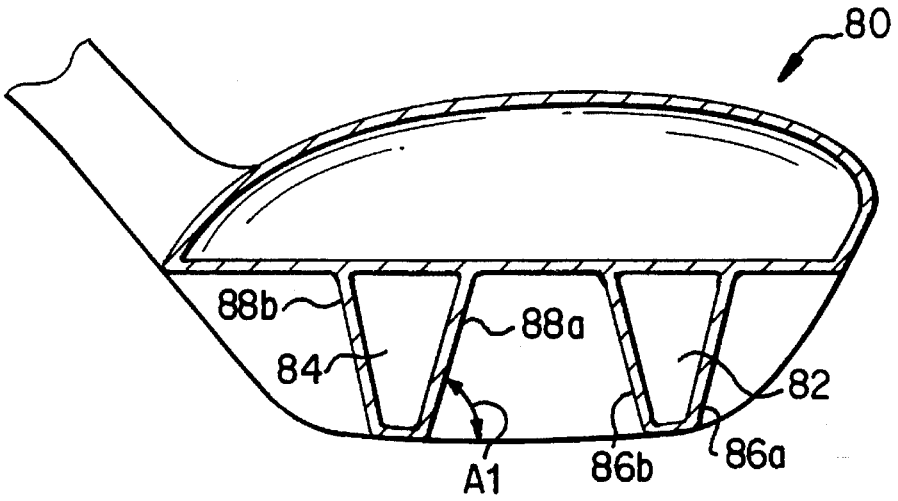
FIG. 10 is a cross-sectional view of the metalwood of FIG. 9 taken along lines 10—10.

Further, although the walls of the rails 56 and 58 have been shown and described as being substantially vertical, it is also possible to provide the rails with angled or sloping walls. For example, referring to FIGS. 9 and 10, a club head 80 according to a second preferred embodiment of the present invention comprises rails 82 and 84 having angled side walls 86*a*, 86*b* and 88*a*, 88*b*, respectively. The walls 86*a*, 86*b* and 88*a*, 88*b* are preferably angled at an angle A1 which ranges from 65 to 85 degrees, and is preferably 75 degrees.

Further yet, the material used for the club head is not critical. Therefore, for the purposes of the present invention, the term "metalwood" as used herein includes club heads made of either metal or composite material, such as kevlar, graphite or carbon.

Figure 11:
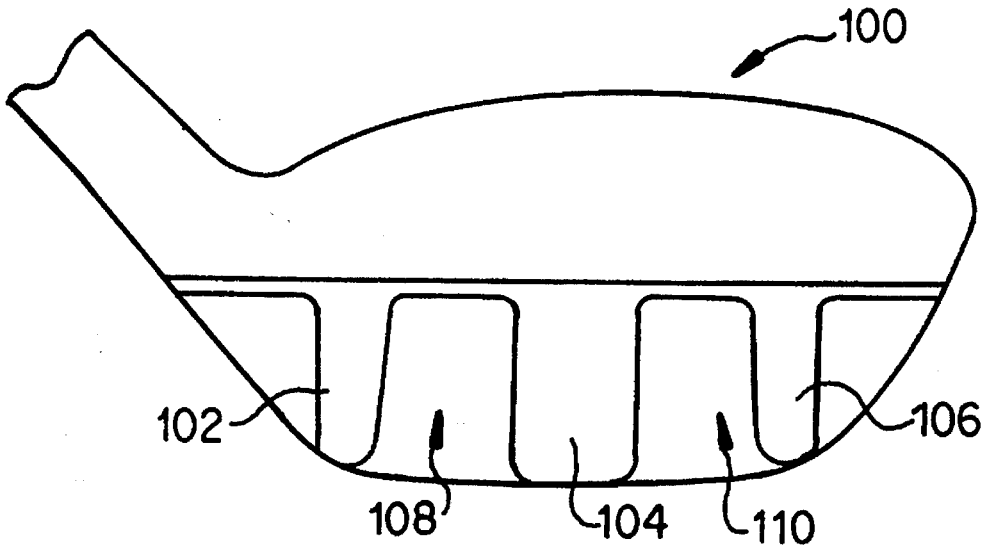
FIG. 11 is a rear view of a third embodiment of the metalwood according to the present invention.
Figure 12:
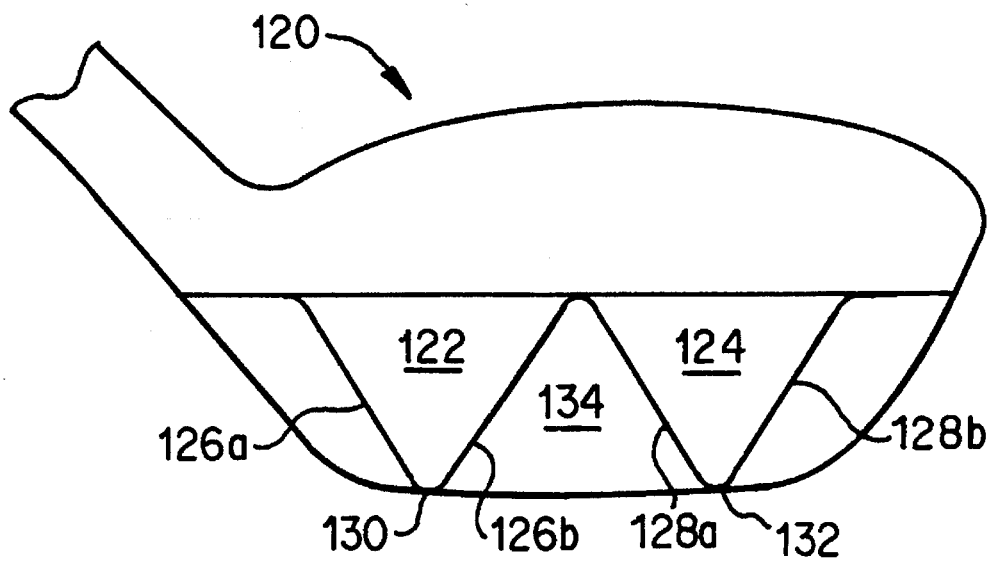
FIG. 12 is a rear view of a fourth embodiment of the metalwood according to the present invention.
Figure 13:
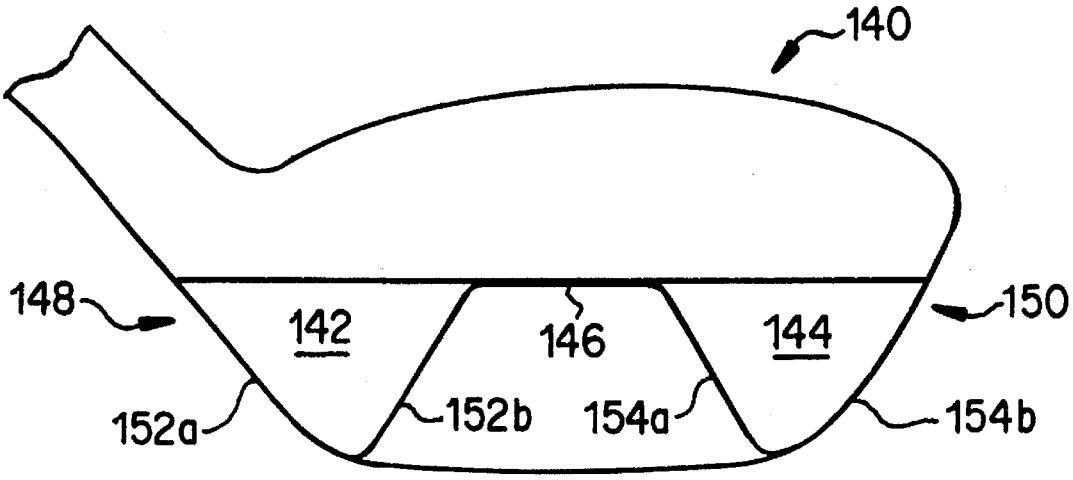
FIG. 13 is a rear view of a fifth embodiment of the metalwood according to the present invention.

FIGS. 11–13 illustrate additional embodiments of metalwood club heads according to the present invention in which the structure of the rails have been further modified. For example, the club head 100 in FIG. 11 is comprised of three rails 102, 104 and 106 defining two troughs 108 and 110 therebetween. The center rail 104 is positioned behind the approximate location of the center of percussion CP, and may be provided with a wider width and greater weight than the adjacent rails 102 and 106. Alternatively, the adjacent rails 104 and 106 may have a wider width and greater weight than the center rail 104, or all three rails 102, 104 and 106 may be provided with the same width and weight. As with the embodiments above, it will be appreciated by those skilled in the art that the width, weight, size and shape of the rails 102, 104 and 106 can be varied without departing from the spirit and scope of the present invention. Also, although this embodiment is provided with three rails, it will be appreciated that more than three rails may also be provided in spaced-apart manner across the sole plate of the club head. The structure and construction of the remainder of the club head 100 may be the same as that of club head 20 of FIGS. 1–8.

As a further example, FIG. 12 illustrates a club head 120 having two rails 122 and 124 having angled or slanted side walls 126*a*, 126*b* and 128*a*, 128*b* in which one side wall 126*b* of one rail 122 is angled to meet, at one end, an end of an adjacent side wall 128*a* of the other rail 124. In fact, the rails 122 and 124 do not have any bottom surfaces since angled side walls 126*a*, 126*b* and 128*a*, 128*b* of each rail 122 and 124, respectively, meet at a tip 130 and 132, respectively, with the tips 130 and 132 resting on the ground at the address position. The trough 134 defined by the two rails 122 and 124 lies directly behind the center of percussion CP. Again, the structure and construction of the remainder of the club head 120 may be the same as that of club head 20 of FIGS. 1–8.

As yet another example, FIG. 13 illustrates a club head 140 having two rails 142 and 144 provided at extreme opposite ends of the sole plate 146. That is, a first rail 142 is provided adjacent the heel portion 148, and a second rail is provided adjacent the toe portion 150. The rails 142 and 144 may be configured with slanted or curved walls. For example, a heel wall 152*a* of the rail 142 may be curved or otherwise angled to be aligned with the configuration of the heel portion 148. Likewise, a toe wall 154*b* of the rail 144 may be curved or otherwise angled to be aligned with the configuration of the toe portion 150. The inner walls 152*b* and 154*a* of the rails 142 and 144, respectively, may be angled at any desired angle or may even be provided vertically. Again, the structure and construction of the remainder of the club head 140 may be the same as that of club head 20 of FIGS. 1–8.

Figure 14:
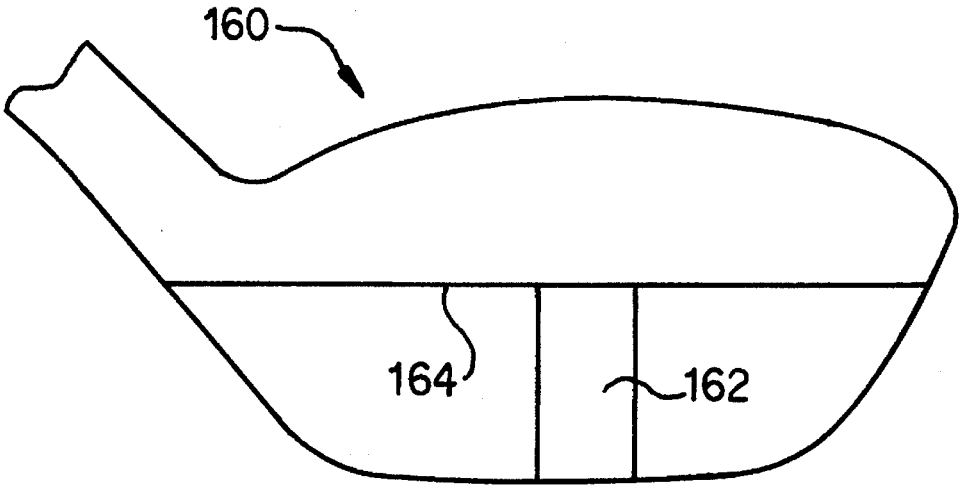
FIG. 14 is a rear view of a sixth embodiment of the metalwood according to the present invention.

FIG. 14 illustrates yet another example, in which the club head 160 is provided with one rail 162 behind the approximate location of the center of percussion CP. The rail 162 may be configured with walls that are either vertical or slanted. If slanted, the walls could be slanted either inwardly from the base 164 to define a narrow bottom surface, or outwardly from the base 164 to define a wider narrow surface. Again, the structure and construction of the remainder of the club head 160 may be the same as that of club head 20 of FIGS. 1–8.

For the club heads 100, 120, 140 and 160 illustrated in FIGS. 11–14, it will be appreciated by those skilled in the art that the width, weight, size and shape of the respective rails can be varied, individually or in combination, without departing from the spirit and scope of the present invention.

Thus, the present invention provides a metalwood club head which concentrates more weight or mass directly behind the center of percussion to help the golfer achieve greater accuracy and increased distance on golf shots. This is accomplished by raising the sole plate of the club head to approximately the same vertical height or level of the center of percussion, which for most metalwood club heads, is at the approximate center of the ball-striking face. This is further accomplished by providing a plurality of rails spaced-apart on the sole plate of the club head. The size, shape, weight and location of these rails can be varied as desired. The raised sole plate and the plurality of rails combine to concentrate additional weight directly behind the center of percussion.

While the description above refers to particular embodiments of the present invention, it will be understood that many modifications may be made without departing from the spirit thereof.

What is claimed is:

1. A metal wood golf club head, comprising:

a toe portion and a heel portion;

a ball-striking face having a top edge, a bottom edge, and a center of percussion located at an approximate center of the face and having a vertical level thereat;

a narrow rear surface having an upper edge and a bottom edge;

a top surface extending from the top edge of the face to the top edge of the narrow rear surface;

a sole plate comprising a narrow leading edge extending substantially horizontally from the bottom edge of the face, and a base extending substantially horizontally from the bottom edge of the narrow rear surface, the base having substantially the same vertical level as the center of percussion; and a plurality of rails extending downwardly from the substantially horizontal base of the sole plate, each rail comprising a bottom surface and two side walls connected by the bottom surface, wherein each bottom surface extends substantially horizontally from the narrow leading edge of the sole plate to support the club head when the club head is rested on the ground.

2. The club head of claim 1, wherein the sole plate further comprises a sloped surface extending at an angle to connect the base and the narrow leading edge.

3. The club head of claim 2, wherein the base comprises a flat surface sloped upwardly from the bottom edge of the narrow rear surface to the sloped surface.

4. The club head of claim 2, wherein the base comprises a flat surface sloped downwardly from the bottom edge of the narrow rear surface to the sloped surface.

5. The club head of claim 1, wherein the base is positioned slightly above the vertical level of the center of percussion.

6. The club head of claim 1, wherein the base is positioned slightly below the vertical level of the center of percussion.

7. The club head of claim 1, wherein the center of percussion comprises a first extremity closer to the heel portion and a second extremity closer to the toe portion, and wherein the plurality of rails comprises two rails, with a first rail positioned behind the face at approximately the first extremity, and a second rail positioned behind the face at approximately the second extremity.

8. The club head of claim 7, wherein the side walls of each rail are substantially vertical.

9. The club head of claim 7, wherein the side walls of each rail are provided at an angle.

10. The club head of claim 7, wherein the first rail has a greater weight than the second rail.

11. The club head of claim 7, wherein the second rail has a greater weight than the first rail.

12. The club head of claim 1, wherein each rail further comprises a rear portion which is curved upwardly from the bottom surface to connect the base of the sole plate.

13. The club head of claim 1, wherein the plurality of rails comprises three rails.

14. The club head of claim 1, wherein the plurality of rails comprises two rails, with a first rail positioned adjacent the heel portion, and a second rail positioned adjacent the toe portion.

15. A metal wood golf club head, comprising:

a toe portion and a heel portion;

a ball-striking face having a top edge, a bottom edge, and a center of percussion located at an approximate center of the face and having a vertical level thereat, the center of percussion further comprising a first extremity closer to the heel portion and a second extremity closer to the toe portion;

a narrow rear surface having an upper edge and a bottom edge;

a top surface extending from the top edge of the face to the top edge of the narrow rear surface; and a sole plate comprising a narrow leading edge extending substantially horizontally from the bottom edge of the face, a base extending substantially horizontally from the bottom edge of the narrow rear surface, and a sloped surface extending at an angle to connect the base and the narrow leading edge, wherein the base has substantially the same vertical level as the center of percussion;

two rails extending downwardly from the base of the sole plate, each rail comprising a bottom surface and two substantially vertical side walls connected by the bottom surface, wherein each bottom surface extends substantially horizontally from the narrow leading edge of the sole plate to support the club head when the club head is rested on the ground, and wherein a first rail is positioned behind the face at approximately the first extremity, and a second rail is positioned behind the face at approximately the second extremity.

16. The club head of claim 15, wherein the base comprises a flat surface sloped upwardly from the bottom edge of the narrow rear surface to the sloped surface.

17. The club head of claim 15, wherein the base comprises a flat surface sloped downwardly from the bottom edge of the narrow rear surface to the sloped surface.

* * * * *